US010672553B2

(12) United States Patent
Volfson

(10) Patent No.: US 10,672,553 B2
(45) Date of Patent: Jun. 2, 2020

(54) HIGH VOLTAGE HIGH FREQUENCY TRANSFORMER

(71) Applicant: Raytheon Company, Waltham, MA (US)

(72) Inventor: Lev Volfson, Framingham, MA (US)

(73) Assignee: RAYTHEON COMPANY, Waltham, MA (US)

( * ) Notice: Subject to any disclaimer, the term of this patent is extended or adjusted under 35 U.S.C. 154(b) by 0 days.

(21) Appl. No.: 15/591,707

(22) Filed: May 10, 2017

(65) Prior Publication Data

US 2018/0330868 A1 Nov. 15, 2018

(51) Int. Cl.

| | |
|---|---|
| ***H01F 27/32*** | (2006.01) |
| ***H01F 27/28*** | (2006.01) |
| ***H01F 27/24*** | (2006.01) |
| ***H01F 41/064*** | (2016.01) |
| ***H01F 41/04*** | (2006.01) |

(Continued)

(52) U.S. Cl.

CPC ..... *H01F 27/2823* (2013.01); *H01F 27/24* (2013.01); *H01F 27/2804* (2013.01); *H01F 27/2885* (2013.01); *H01F 27/306* (2013.01); *H01F 27/324* (2013.01); *H01F 38/00* (2013.01); *H01F 41/041* (2013.01);

(Continued)

(58) Field of Classification Search

CPC .. H01F 27/2823; H01F 27/24; H01F 27/2804; H01F 27/2885; H01F 27/324; H01F 27/2814; H01F 27/2871; H01F 27/288; H01F 27/29; H01F 27/32; H01F 27/323; H01F 41/064; H01F 41/041

USPC ..... 336/170, 212, 220–222, 84 R, 84 C, 336/84 M, 205, 207, 214, 215, 192; 29/602.1, 605, 606

See application file for complete search history.

(56) References Cited

U.S. PATENT DOCUMENTS

| | | | |
|---|---|---|---|
| 4,858,095 | A | 8/1989 | Narita et al. |
| 4,942,353 | A | 7/1990 | Herbert |

(Continued)

FOREIGN PATENT DOCUMENTS

| | | | |
|---|---|---|---|
| EP | 2400511 | A1 | 12/2011 |
| GB | 376817 | A | 7/1932 |
| WO | 0025141 | A1 | 5/2000 |

OTHER PUBLICATIONS

B. Jacobson, et al, "Planar Integrated Magnetics Assembly for High Voltage Converters", IEEE APEC, 2000, pp. 627-632, 6 pages.

(Continued)

*Primary Examiner* — Mang Tin Bik Lian
(74) *Attorney, Agent, or Firm* — Cantor Colburn LLP

(57) ABSTRACT

According to one embodiment a transformer that includes a core having a central arm and first and second outer arms on opposite sides of the of the central arm, a primary winding surrounding the central arm and a secondary winding surrounding the central arm is disclosed. The transformer further includes a primary winding casing surrounding the primary winding, a secondary winding casing surrounding the secondary winding, and at least two spacers including a first spacer and a second spacer. The first spacer is configured and arranged to space the primary winding casing away from a bottom of the core and the outer arms and the second spacer is configured and arranged to space the secondary winding casing away from the primary winding casing and the outer arms.

17 Claims, 11 Drawing Sheets

(51) Int. Cl.
*H01F 38/00* (2006.01)
*H01F 27/30* (2006.01)
*H01F 27/36* (2006.01)

(52) U.S. Cl.
CPC ..... *H01F 41/064* (2016.01); *H01F 27/362* (2013.01); *H01F 2038/003* (2013.01)

(56) References Cited

U.S. PATENT DOCUMENTS 4,977,301 A 12/1990 Maehara
4,978,906 A 12/1990 Herbert
5,312,674 A 5/1994 Haertling
5,559,487 A * 9/1996 Butcher ..... H01F 27/324 336/178
5,745,981 A 5/1998 Roshen
5,777,539 A 7/1998 Folker
5,886,610 A 3/1999 Canova
5,959,522 A 9/1999 Andrews
5,973,923 A 10/1999 Jitaru
5,990,776 A 11/1999 Jitaru
5,999,078 A 12/1999 Herbert
6,445,272 B1 9/2002 Mercado
6,628,531 B2 9/2003 Dadafshar
6,727,793 B2 4/2004 Piechnick
6,820,321 B2 11/2004 Harding
6,847,284 B2 1/2005 Gamou
7,084,728 B2 8/2006 Hyvonen
7,187,263 B2 3/2007 Vinciarelli
7,248,138 B2 7/2007 Chiang
7,262,680 B2 8/2007 Wang
7,304,862 B2 12/2007 Busletta
7,361,847 B2 4/2008 Dunn
7,382,219 B1 6/2008 Lee
7,477,120 B2 1/2009 Gu et al.
8,089,331 B2 1/2012 Jacobson
8,593,245 B2 * 11/2013 Zeng ..... H01F 27/2885 336/200
9,373,440 B2 6/2016 Chou
10,049,810 B2 8/2018 Jacobson et al.
10,050,533 B2 10/2018 Jacobson et al.
2002/0039062 A1 4/2002 Kvarnsjo
2003/0095026 A1 5/2003 Kawanobe
2004/0032313 A1 2/2004 Ferencz
2004/0108929 A1 * 6/2004 Ichikawa ..... H01F 27/2823 336/83
2004/0240126 A1 12/2004 Tiemeijer
2006/0232301 A1 10/2006 Morlion et al.
2006/0267718 A1 11/2006 Salama et al.
2007/0018334 A1 1/2007 Peytavy et al.
2007/0217168 A1 9/2007 Masuyama et al.
2008/0007249 A1 1/2008 Wilkerson et al.
2008/0094166 A1 4/2008 Hsu et al.
2009/0115564 A1 5/2009 Minteer et al.
2009/0189725 A1 7/2009 Ding et al.
2013/0207767 A1 * 8/2013 Worthington ..... H01F 27/2804 336/84 C
2014/0139313 A1 5/2014 Zhou et al.
2014/0327511 A1 11/2014 Tsai et al.
2014/0347158 A1 11/2014 Goeke et al.

OTHER PUBLICATIONS

Communication Relating to the Results of the Partial International Search for application No. PCT/US2018/031482, dated Aug. 18, 2018, 100 Pages.

* cited by examiner

HIGH VOLTAGE HIGH FREQUENCY TRANSFORMER

BACKGROUND

The present invention relates to providing power and, more specifically, to providing a compact, high-voltage, high-frequency transformer to provide power.

Power converters are used to convert power from an input to a needed power for provision to a load. One type of power converter is a transformer. Transformers may be designed to convert a fixed AC input voltage into a higher or lower AC voltage. The architecture chosen may provide for high frequency operation, pulse-width-modulation, isolation, and the like.

Different types of transformers may be used depending on a particular application. A typical power transformer includes one or more input windings and one or more output windings. The input and output windings are both wrapped around a core formed of a magnetic material. An alternating current provided at the input (e.g., primary) windings causes a varying magnetic flux in the transformer core. This flux leads to a time varying magnetic field that includes a voltage in the output (e.g., secondary) windings of the transformer.

In some cases, the core is so-called "closed-core." An example of closed-core is a "shell form" core. In a shell form, the primary and secondary windings are both wrapped around a central core arm and a both surrounded by outer arms. In some cases, more than one primary winding is provided and multiple secondary windings may also be provided. In such systems, based on the input and to which of the primary windings that input is provided (of course, power could also be provided to more than one primary winding in some instances) different output voltages can be created at each of the secondary windings.

Some power transformers operate at high voltages and/or currents. Such power transformers may produce strong electromagnetic (EM) fields. One approach to deal with the electric fields and parasitic currents they produce is to shield one or both of the primary and secondary windings. This may be especially important where the power transformer operates in high, very-high or ultra-high frequency bands. An example is a power transformer used in a microwave power module.

In some applications, the cost of high frequency and/or high voltage transformers for use in compact equipment can be high relative to the cost of the equipment as a whole or compared to other elements in the equipment. Further, in some cases, the transformer can be difficult to make or prone to failures.

SUMMARY

According to one embodiment a transformer that includes a core having a central arm and first and second outer arms on opposite sides of the of the central arm, a primary winding surrounding the central arm and a secondary winding surrounding the central arm is disclosed. The transformer further includes a primary winding casing surrounding the primary winding, a secondary winding casing surrounding the secondary winding, and at least two spacers including a first spacer and a second spacer. The first spacer is configured and arranged to space the primary winding casing away from a bottom of the core and the outer arms and the second spacer is configured and arranged to space the secondary winding casing away from the primary winding casing and the outer arms.

In another embodiment, a method of forming a transformer is disclosed. The method includes: providing core having a central arm and first and second outer arms on opposite sides of the of the central arm; forming a first winding; forming a second winding; disposing the first winding in a first winding casing; disposing the second winding in a second winding casing; placing a first spacer on a lower portion of the core; disposing the first winding casing on the first spacer and such that is surrounds the central arm; placing a second spacer on top of the first winding; and disposing the second winding casing such that is surrounds the central arm and contacts the second spacer.

In one embodiment, a shielded transformer winding assembly that includes a first winding formed on a first printed circuit board is disclosed. The first printed circuit board includes at least two first board alignment elements formed therein. The transformer also includes a casing including an inner portion and one or more tabs that extend outwardly from the inner portion the tabs arranged to form a notch between them and a lower winding spacer disposed in one of the tabs. The lower winding spacer includes a stepped mounting member including first mounting member portion and a second mounting member portion with the second mounting member portion having a smaller outer perimeter than and extending from the first mounting member portion. The first winding is disposed within the casing and on the lower winding spacer such that the second mounting member portion extends through one of the at least two first board alignment elements and wherein the first printed circuit board is supported by the first mounting member portion.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

As will be described below, a multiple primary and second winding transformer is disclosed. The windings may be printed on one or more printed circuit boards (PCBs) and the primary windings are shielded from the secondary windings by surrounding one or both in an outer case. The outer case can be toroidal shaped and formed of two portions that can snap together. The two or more portions are coated inside and outside with an EMI (electromagnetic interference) coating that changes the contour of high voltage (HV) electric fields. Each case includes an access port to allow for connection to the windings therein. As will be more fully understood, the shape of the cases can be such that they engage with a magnetic core. Also provided are spacing elements that arrange and space the cases relative to one another. Each casing can include one or more standoffs and spacers to space and arrange the windings within in the cases relative to the cases and each other.

Figure 1:
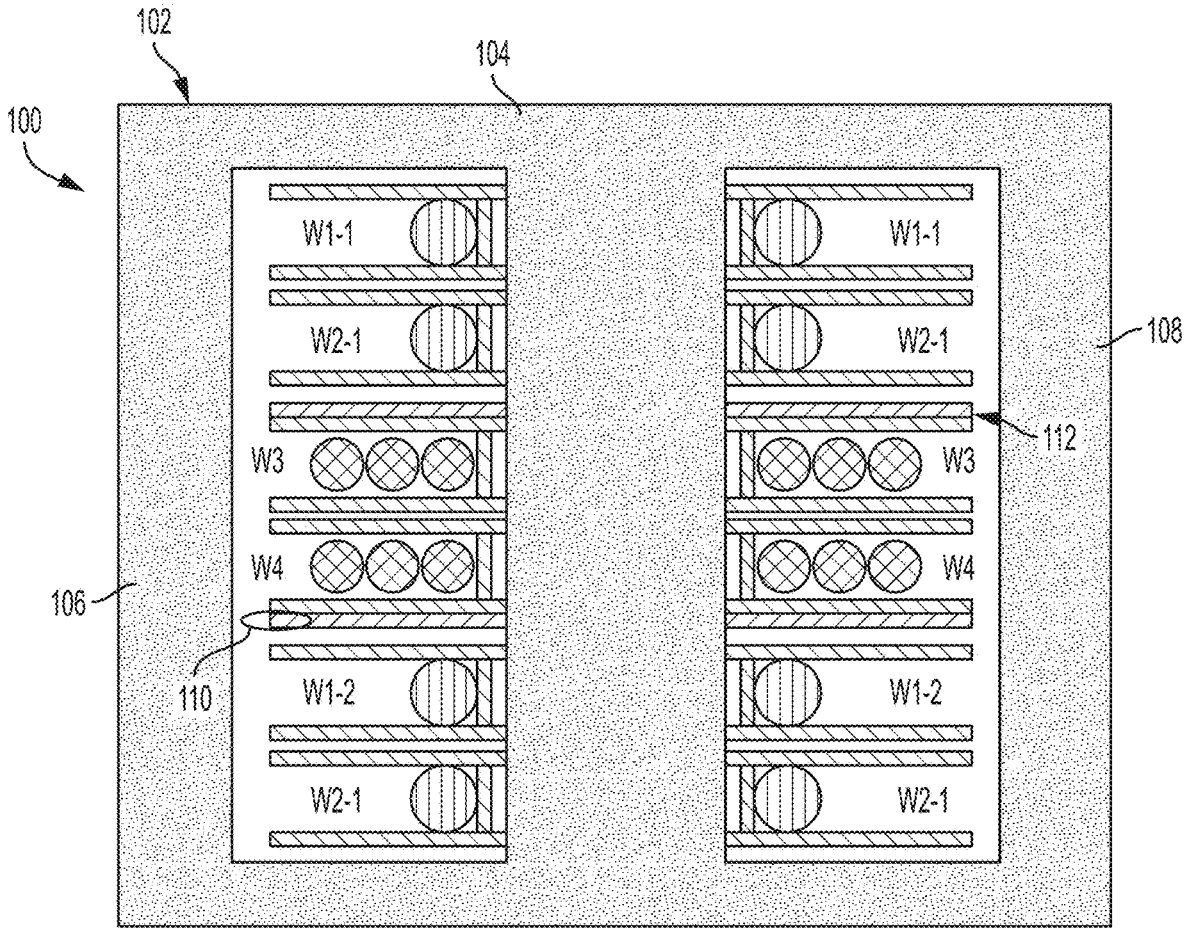
FIG. 1 PRIOR ART
FIG. 1 shows a cross section of a transformer with multiple primary and multiple secondary windings and a shell form core.

FIG. 1 shows an example of a prior art transformer. As illustrated, the transformer 100 includes a core 102. The core 102 may be formed in the prior art and in embodiments disclosed herein by a metal or other magnetically conductive material. Examples includes include ferromagnetic metal such as iron, or ferromagnetic compounds such as ferrites. Other examples include laminated silicon steel. The teachings herein are applied to a core 102 that is of the closed variety and in particular to a shell core having a central arm 104 and outer arms 106, 108.

As illustrated, the transformer 100 includes four primary windings, each having a single turn and are labelled as a first primary winding W1-1, a second primary winding W2-1, a third primary winding W1-2 and a fourth primary winding W2-1. In this and other examples, the primary windings are part of the so-called "low voltage" side of the transformer and each include one spiral The illustrated transformer includes two secondary windings W3 and W4 both formed of three spirals. In this and other examples, the secondary windings are part of the so-called "high voltage" side of the transformer and each include 3 spirals turns. A low voltage provided to the one or more of the primary winding creates a higher voltage in the secondary windings. Of course, if the number of spirals one the primary and secondary could be changes and, accordingly the naming secondary would be low voltage side.

In the example shown in FIG. 1, the primary windings are shielded from the secondary windings W3, W4 by shields 110 and 112. The shields 110, 112 can be an electrostatic shield formed of a conductive metal such a copper. The shields 110, 112 may minimize conducted (coupled through parasitic capacitance) and radiated emissions from secondary-winding high-voltage spikes being transmitted to the primary windings or vice-versa. In some cases, the shield is placed between a transformer's primary and secondary windings to reduce EMI and usually consists of one turn of thin copper foil around the secondary windings. The shield 110 may be coupled to a circuit or system ground that is attached to prevent high-frequency current from coupling.

It has been discovered that sharp edges in a high voltage (HV) region (e.g., near the secondary windings W3, W4) provide locations where partial discharges (coronas) may form. However, foil-based shields and windings made with small diameter wire (in the range of several mils) may create such edges leading to a high-intensity electric field that forms such partial discharges.

Figure 2:
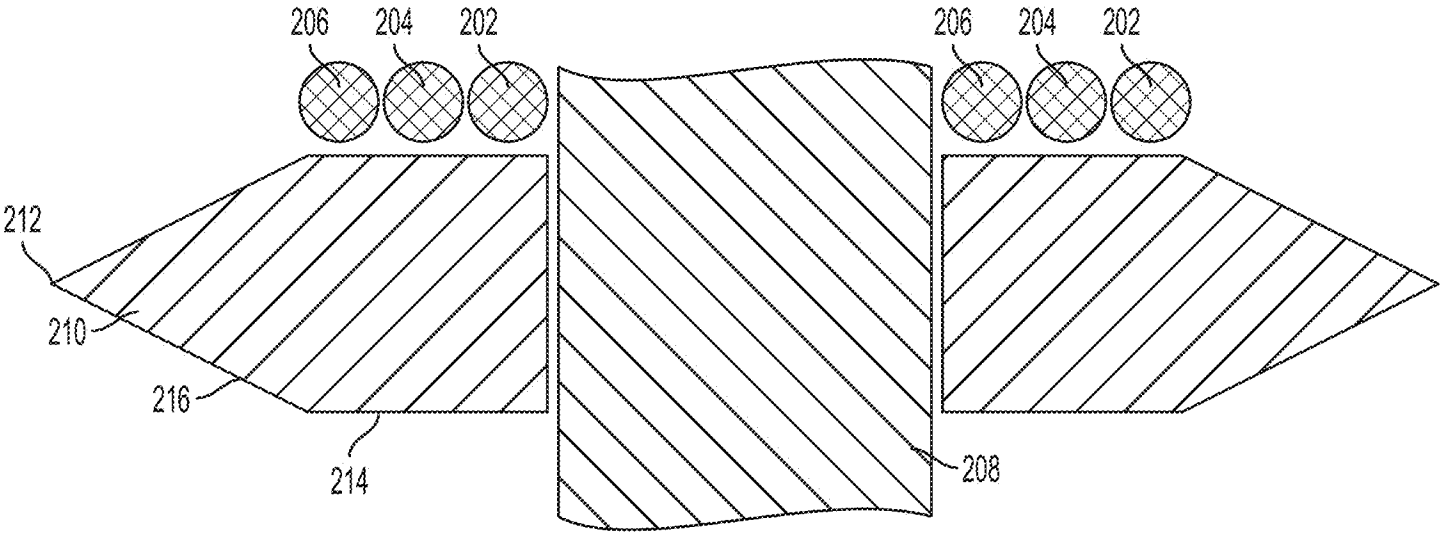
FIG. 2 shows a close up cut-away side view of three windings surrounding a core arm.

For example, FIG. 2 shows a partial cross section of an example shield 210 disposed below three winding turns 202, 204, 206. The windings are wrapped around an arm 208 (e.g., a central arm) of a core. These winding turns 202-206 are shown as being formed of cylindrical wire and are by way of example only. In FIG. 2, an outer edge 212 of the foil shield 210 is one place where discharge may occur while the fields are much lower in smooth regions such a regions 214 and 216. In short, locations where a foil or other shield 210 form a sharp edge can lead to less than desirable results. One approach is to, therefore, not include the shield. However, this may result in the increased inter-winding capacitance described above, increased parasitic primary-to-secondary currents and degraded safety. The shield is not the only source of corona because windings made out of fine wire also produce a large electric field gradient.

In some cases high-voltage, high-frequency transformers often use flat, "pancake" windings to reduce the transformer primary-to-secondary equivalent capacitance. This could lead to a solution where a shield may not be needed. These windings, however, can be labor intensive to use.

Another approach to reduce transformer cost is to form planar windings on a printed circuit board (PCB). However, such windings may have sharp edges that further increase electric field intensity.

One solution is to provide smooth toroid-shaped shields on the inside a tube surrounding one or windings. Examples of such solutions are provided in U.S. patent application Ser. No. 14/935,608, filed 9 Nov. 2015, entitled HIGH VOLTAGE HIGH FREQUENCY TRANSFORMER and U.S. patent application Ser. No. 15/219,674, filed 26 Jul. 2016, entitled HIGH VOLTAGE HIGH FREQUENCY TRANSFORMER, both of which are incorporated herein by reference in their entirety. The discussion related to FIGS. 3A-3C below provides a general description of the solution provided in the above related applications.

Figure 3A:
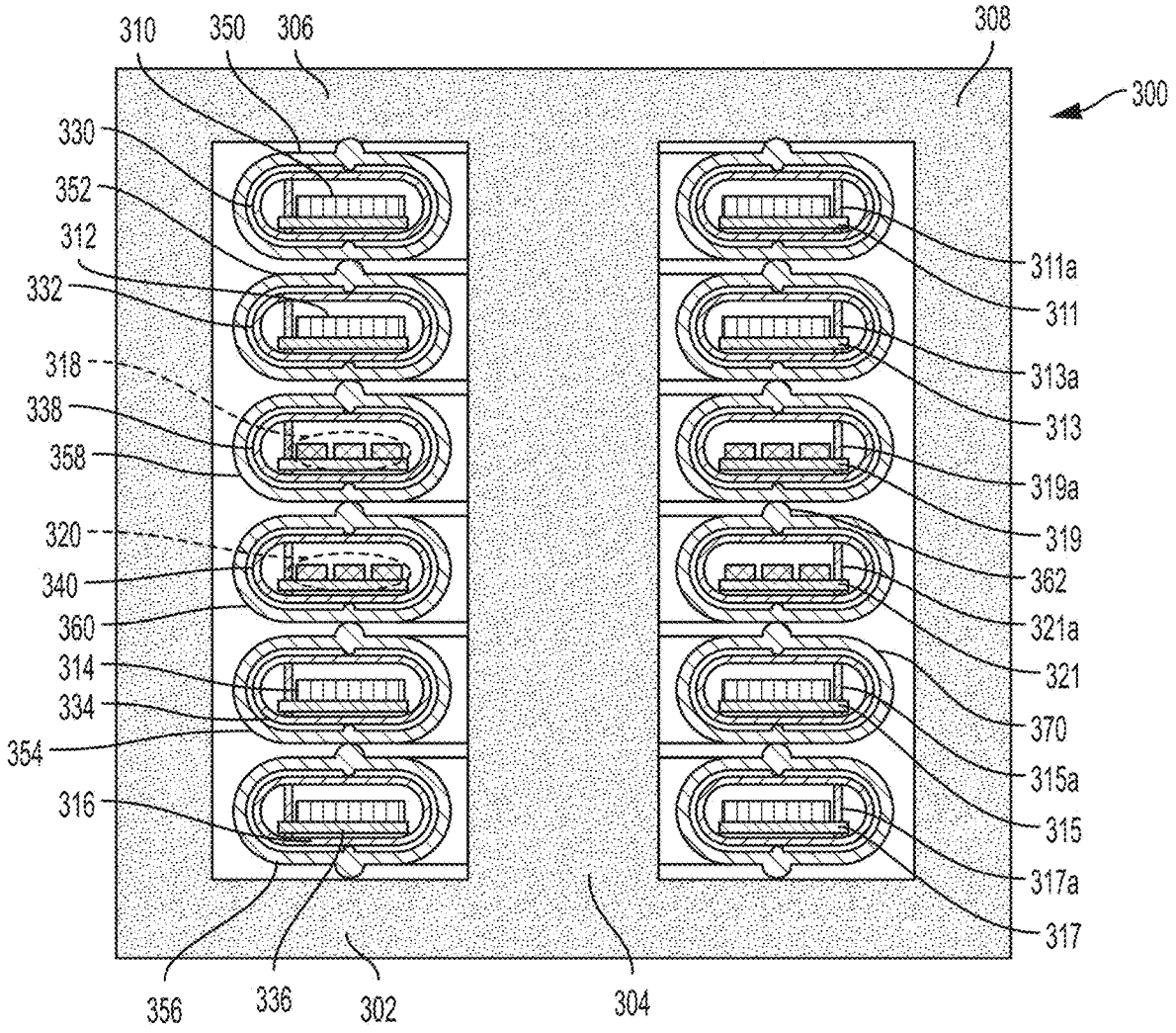
FIGS. 3A, 3B and 3C show, respectively, a cut-away side view of a transformer with six shielded and insulated sections according to one embodiment formed with square-edged winding traces, a circuit diagram of the transformer of FIG. 3A and a cut-away side view of a transformer with three shielded and insulated sections.

FIG. 3A shows a side view of an example of transformer 300 according to one embodiment. While specific turns ratios and interleaving of primary and secondary windings is shown in FIG. 3A it shall be understood that the teachings herein can be applied to any implementation of a transformer regardless of turns ratios or the exact orientation of the primary and secondary windings.

The transformer 300 includes a core 302. The core 302, as described above, may be formed a metal or other magnetically conductive material. Examples includes include ferromagnetic metal such as iron, or ferromagnetic compounds such as ferrites. Other examples include laminated silicon steel. The illustrated core 302 is of the closed variety, and in particular to a shell core, having a central arm 304 and outer arms 306, 308.

As illustrated, the transformer includes a first pair of primary windings 310, 312 and a second pair of primary windings 314, 316. Each of these windings are illustrated as being formed of a single turn. Of course, the number of and turns of each primary windings may be limited varied as long as one primary winding is provided that has at least one turn. In embodiments herein, one or more of the primary windings 310, 312, 314, 316 are planar windings formed on and supported by a substrate. As illustrated, each winding 310, 312, 314, 316 is formed on and supported by a substrate labeled as 311, 313, 315, 317 formed of a dielectric material.

The transformer 300 also includes secondary windings 318, 320. Each of these windings is illustrated as being formed of three turns. Of course, the number of and turns of each secondary winding 318, 320 may be limited varied as long as one secondary winding is provided that has at least one turn. In embodiments herein, one or more of the secondary windings 318, 320 are planar windings formed on and supported by a substrate. As illustrated, each winding 318, 320 is formed on and supported by a substrate labeled as 319, 321 formed of a dielectric material.

In this manner, one or more of the primary and secondary windings may be formed as part of a printed circuit board. In the prior art using such windings was typically avoided as the traces forming the windings have sharp edges that further increase electric field intensity at those locations and can lead the same or similar problems discussed above with respect to sharp shield edges.

To overcome one or more of the possible problems described above, one or more toroid-shaped shields are provided. As illustrated, each winding 310, 312, 314, 316, 318, 320 is surrounded by a toroid shaped shield. In particular, windings 310, 312, 314, 316, 318, 320 are surrounded by shields 330, 332, 334, 336, 338, 340, respectively. That is, in this embodiment, each winding includes its own shield. In an alternative embodiment, and as shown in FIG. 3C, each pair of primary windings 310, 312 and 314, 316 is within a single primary shield 380, 382, respectively and both secondary windings 318, 320 are within a single secondary shield 384.

Each of the substrates 311, 313, 315, 317, 319 and 321 may be supported within their respective shields by a respective support member 311*a*-321*a*. The support member may be formed of a dielectric or other not conductive material in one embodiment. The support members can be formed at part of the substrate and sided and arranged such that contact a top and bottom surface of the shields to provide a rigid support from which its respective substrate may extend.

In one embodiment, each shield 330, 332, 334, 336, 338, 340 is surrounded by a respective insulating tube 350, 352, 354, 356, 358, 360. (as shown, the tubes are in the form of a hollow toroid) The tube may be formed of any nonconductive material. One or more of the insulating tube 350, 352, 354, 356, 358, 360 may include an optional offset member 362 that provides a means to slightly separate the insulating tubes from one another.

According to one embodiment, one or more of the shields 330, 332, 334, 336, 338, 340 may be shaped such that a portion that is not flat is arc shaped That is, one embodiment, one or more of the shields may be shaped such that, in cross section, they do not have any sharp edges, corners, or discontinuous surfaces. However, as will be discussed below, one or more cuts may be made to the shields but these, while they may introduce a discontinuity at the location of the cut, the cut does not change the shape of the cross-section of the shield. The shields function to change the contour of the HV electric field (e.g., emerging from the flat windings) to reduce its intensity and eliminate ionization.

Figure 3B:
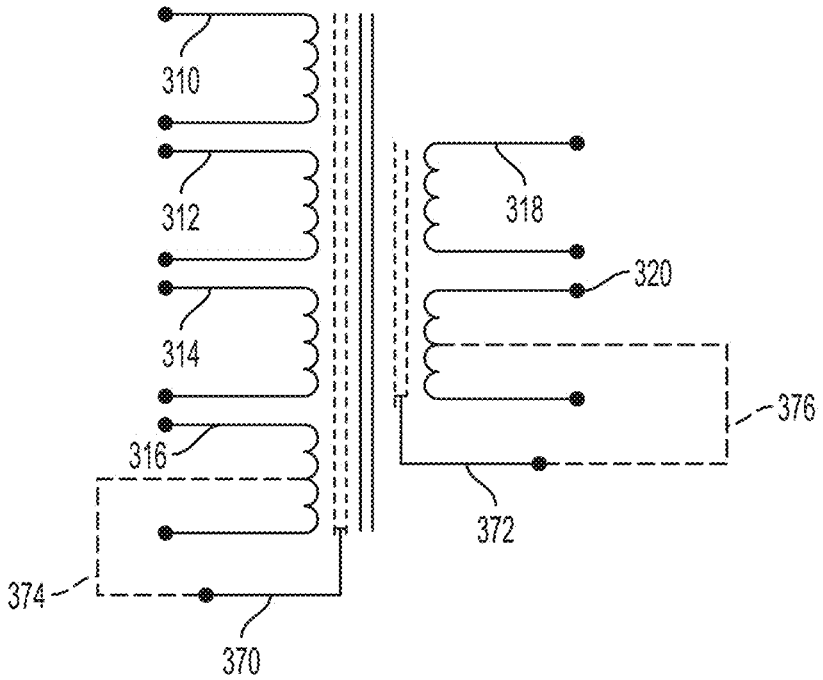
Figure 3C:
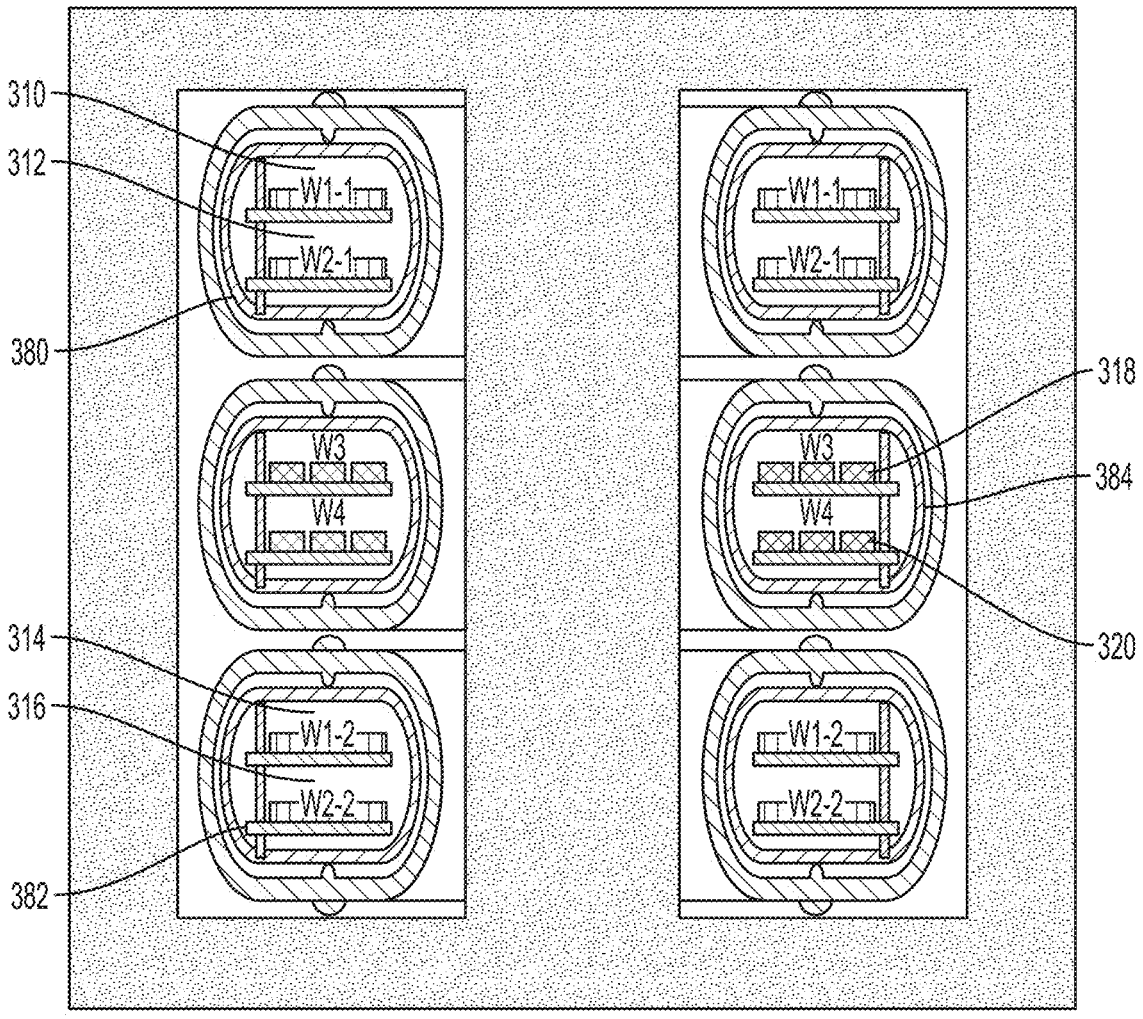

FIG. 3B shows a circuit diagram of the transformer shown in FIG. 3A. In this depiction, the shields are divided into primary and secondary shields 370, 372. In one embodiment, the primary shield 370 in actually the electrical equivalent of shields 330, 332, 334, 336 and the secondary shield 372 is the electrical equivalent of shields 338 and 340. The primary shield 352 is connected to a steady potential at the primary side and the secondary shield is connected to a potential on the secondary side. Examples of a steady potential include a center tap of the transformer winding (see optional connections 374, 376), a neutral point (if a three-phase transformer with star connection of windings is used) or any DC potential available in the power converter using this transformer. In one embodiment, the DC voltages help maintain a minimum voltage difference between the shields and the enclosed windings.

Figure 4A:
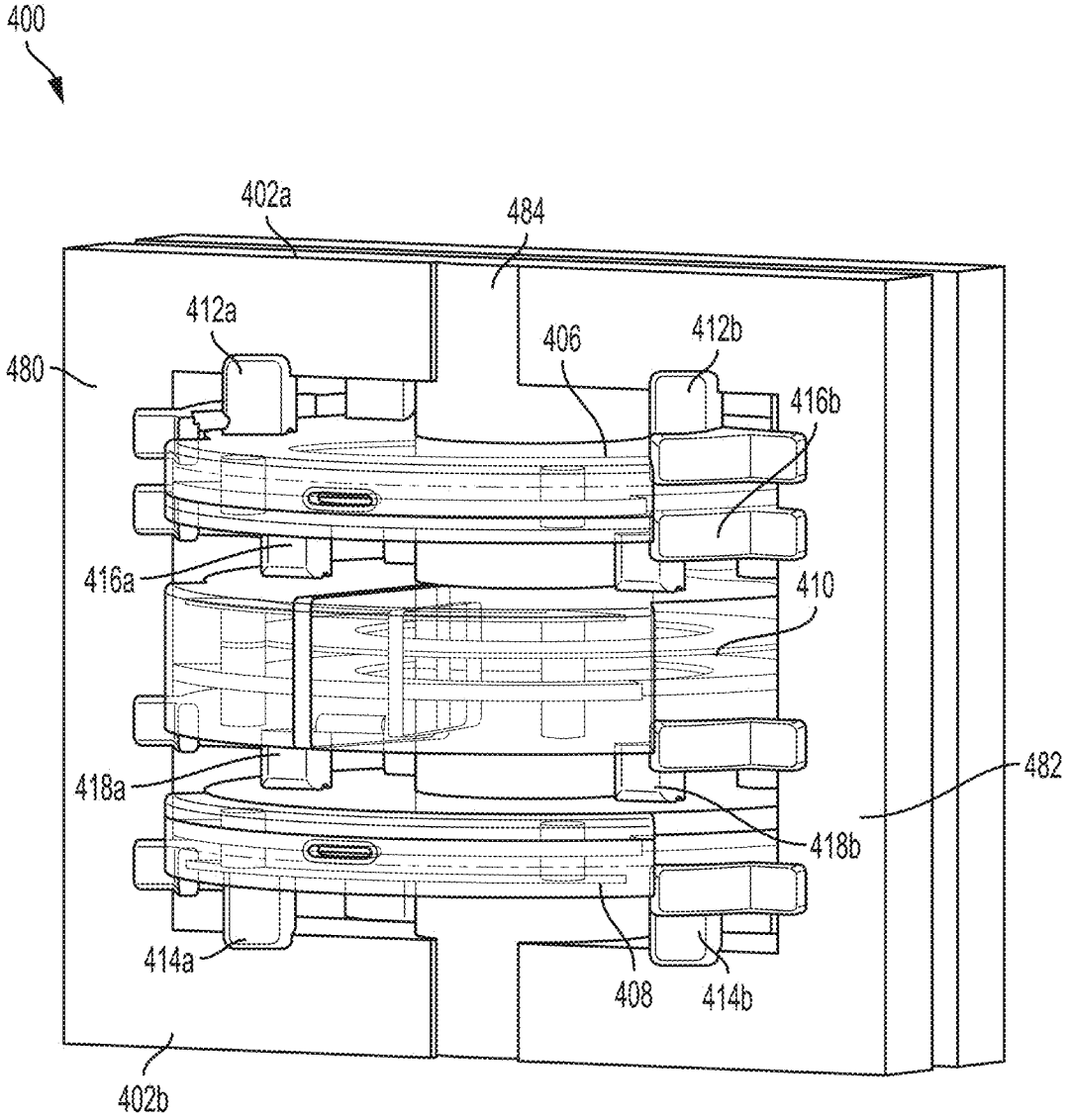
FIGS. 4A and 4B are perspective and cut-away views of a transformer according to one embodiment.

The following discussion provides for a practical manner in which the embodiments of FIGS. 3A and 3C may be formed and constructed. With reference now to FIG. 4A an example of transformer 400 is illustrated in a perspective view. The transformer is formed on and includes a H-shaped core 402 that includes two halves 402, 404 (referred to as upper and lower halves, respectively, herein).

The transformer includes two primary sections including first primary section 406 and a second primary section 408. The primary sections 406, 408 can contain one or more primary windings that formed as traces on a printed circuit board as described above. For example, primary section 406 can include windings W1-1 and W2-1 and primary section 408 can include primary windings W1-2 and W2-2. As discussed further below, each of the primary sections 406, 408 can be formed of a non-conducting material and have shielding disposed both on an inside and an outside thereof. In one embodiment, the shielding material is copper based.

The transformer 400 also includes at least one secondary section 410. Of course, the transformer 400 could have more than one secondary section 410. The secondary section can contain one or more primary windings that formed as traces on a printed circuit board as described above. For example, the secondary section 410 can include windings W3 and W4. Similar to the primary sections 406, 408, the secondary section 410 can be formed of a non-conducting material and have shielding disposed both on an inside and an outside thereof. In one embodiment, the shielding material is copper based.

The transformer 400 also includes a plurality of spacing elements that space the sections 406, 408 and 410 from the core 402 and each other. As illustrated, the transformer 400 includes upper spacers 412*a*, 412*b* and lower spacer 414*a*, 414*b*. Each of the upper and lower spacers are shown as being formed or two separate portions. However, each spacer could be a unitary element in one embodiment. The upper and lower 412, 414 spacers space the upper and lower portions 406, 408, respectively, from the upper and lower halves 402*a*, 402*b* of the core 402.

The transformer 400 also include upper inner spacers 416*a*, 416*b* and lower inner spacers 418*a*, 418*b*. Each of the upper inner and lower inner spacers are shown as being formed of two separate portions. However, each spacer but could be a unitary element in one embodiment. The upper inner and lower inner 416, 418 spacers space the inner portion 410 from the upper and lower portions 406, 408, respectively. The upper inner and lower inner 416, 418 spacers also space the secondary section 410 from the core 402.

As illustrated, the lower spacers 414 are disposed between the core and the second primary section 408. The lower inner spacers 418 are disposed between the second primary section 408 and the secondary section 410. The upper inner spacers 416 are disposed between the secondary section 410 and the first primary section 406. The upper spacers 412 are disposed between the core and the first primary section 406.

Figure 4B:
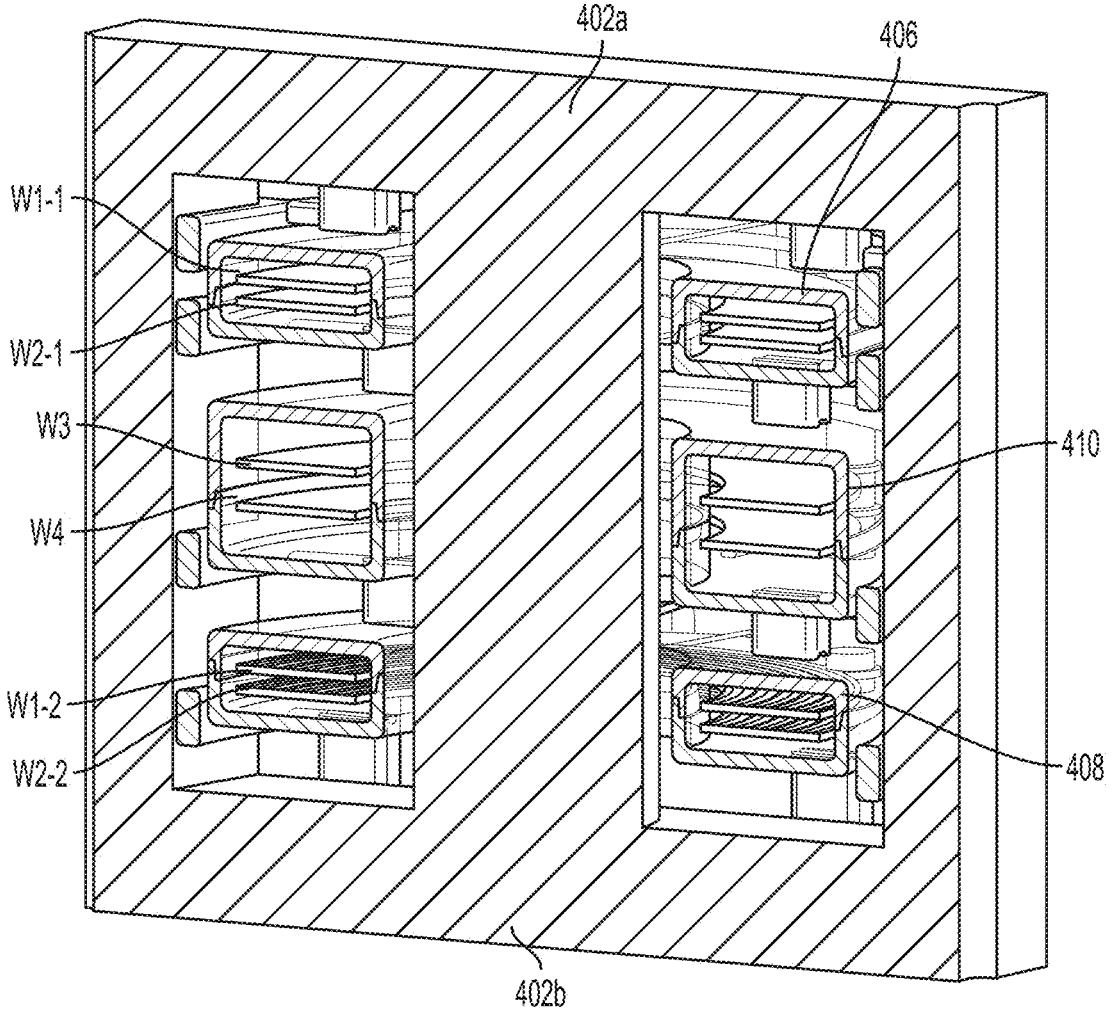

With reference now to FIG. 4B, a cross-section of the transformer 400 of FIG. 4A is illustrated. As shown, primary section 406 includes windings W1-1, W2-1, primary section 408 include primary windings W1-2 and W2-2, and the secondary section 410 includes windings W3 and W4. OF course, the number and arrangement of windings is not limited to the particular, arrangement shown in FIG. 4B.

Figure 5A:
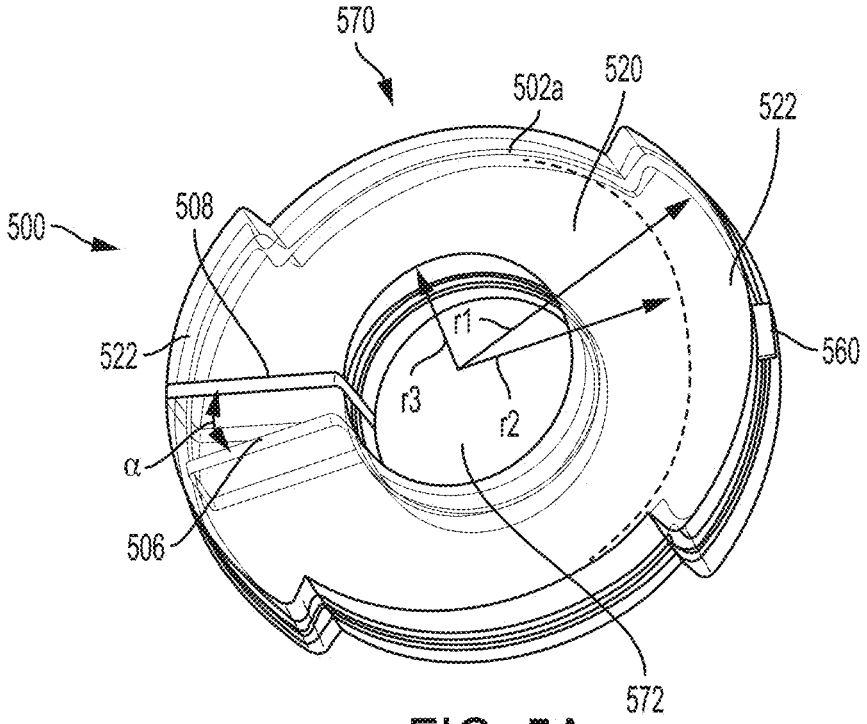
FIGS. 5A and 5B show perspective and cross-sectional views of a transformer winding casing according to one embodiment.
Figure 5B:
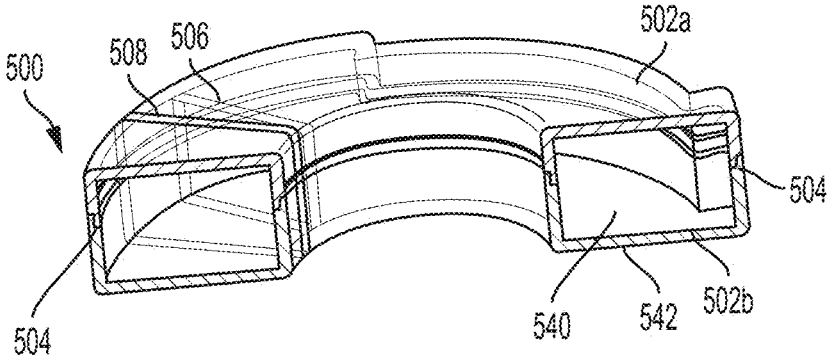

FIGS. 5A and 5B show perspective and cut-away views of a casing that surrounds one or portions (e.g., primary or secondary portions). The casing 500 can be formed of a nonconductive material. In one embodiment, the casing is formed by a selective laser sintering (SLS) additive manufacturing process. The casing 500 may be formed as two halves 502*a*, 502*b* that can snap together in one embodiment. A displaced cut 504 that is sloped (e.g., not perpendicular to) relative to a wall of the casing 500.

Both inner and outer surfaces of the casing are covered by conductive coating to form the shields described above. To avoid shorting the transformer, the shield on both the inner and outer surfaces has to have a single cut formed therein. In FIGS. 5A and 5B, the cuts are shown, respectively, as cuts 506, 508. The cuts are provided due to the fact that if a shield forms a continuous loop around the center leg of the core, it will act as a shorted turn of the winding and, in effect, short circuit the transformer. However, the location of the cut may create edges leading to high intensity field in its immediate vicinity bringing back the initial corona problem discussed above. To address this situation, and as shown in FIGS. 5A and 5B, the casing 500 may be formed such that it includes body (502*a*/502*b*) formed of a an insulating material. Inner and outer surfaces of the casing 500 are coated with inner and outer metallic layers 540, 542. As these layers do not conduct significant current, the metallic layers may be formed by any method of metallic deposition. With reference to FIG. 3B, it shall be understood that both inner and outer metallic layers 504, 506 may be connected to the same voltage (e.g., combined they form a shield and a connected to either the primary side DC voltage or the secondary side DC voltage depending on whether the winding it is shielding is on the primary or secondary side.

In one embodiment, the cuts 506, 508 in each layer 540, 542 is separated by an angle $\alpha$ that is greater than approximately 18 degrees. As the two metallic layers 540, 542 are closely spaced, their composite electric field may have low intensity.

FIG. 5A also illustrates an alignment feature of the casing 500. The casing 500 includes an inner portion 520 and one or more tabs 522 that extend outwardly from the inner portion 520. As shown, the inner portion has an inner radius r2. The tabs 522 extend outwardly from the inner portion and are defined as having an outer radius r1 that is greater than r2. The space 570 between the tabs 522 is referred to as a "notch" herein. The notch 570 is sized and arranged to mate with the spacers described.

FIG. 5B also shows a turn entrance 560 through which power may be provided to our drawn from the windings in the casing 500. In one embodiment, turn entrances for primary windings are on one side of the transformer and a turn entrance for the secondary windings is on the other. However, as the skilled artisan will realize from the disclosure herein, the tabs can be symmetrical to allow for any arrangement of turns entrances as needed.

Figure 6:
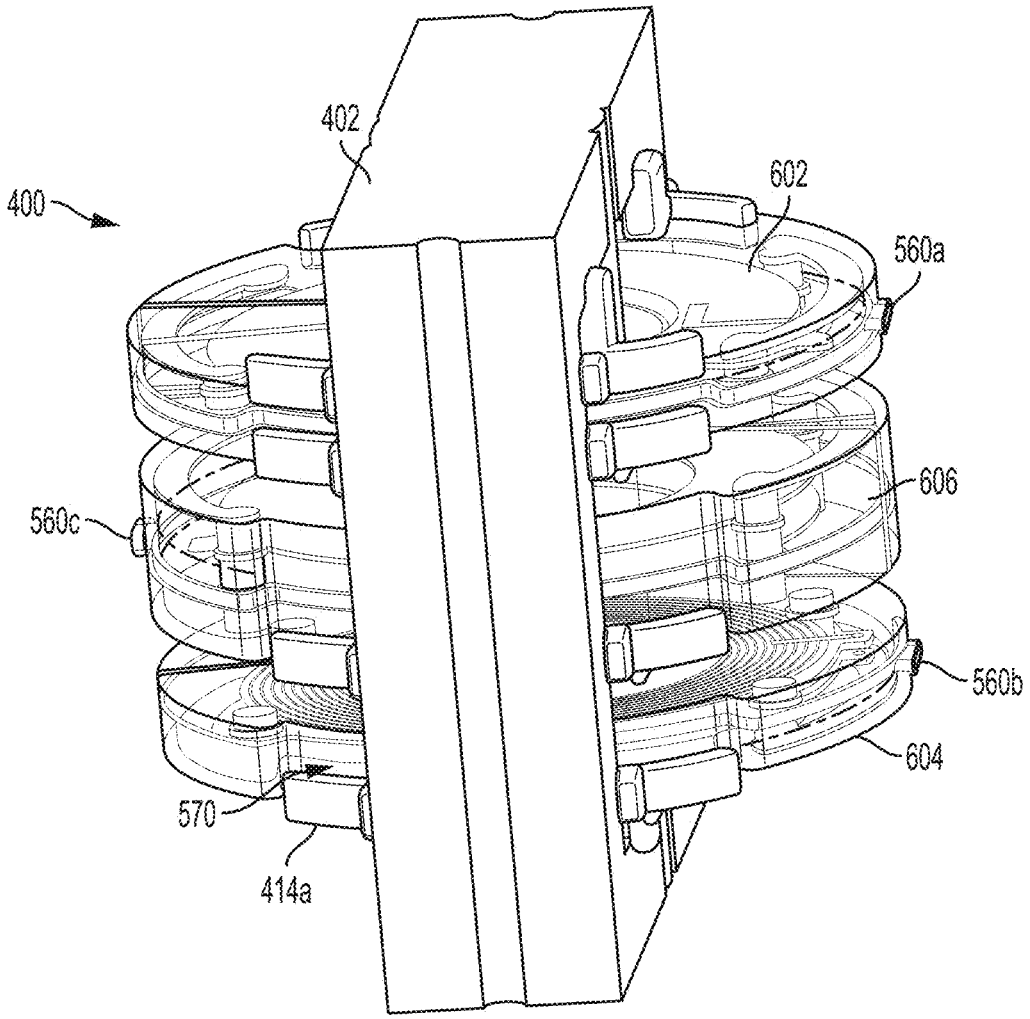
FIG. 6 shows a different perspective view of the transformer shown in FIG. 4A.

With reference to FIG. 6, one configuration with turn entrance 560*a* for primary casing 602 and turn entrance 560*b* for primary casing 604 both being on one side and turn entrance 560*c* being on the other side. As shown, the spacer 414*a* is in the notch 570 of the casing 604.

To assemble the transformer 400 shown in FIGS. 4A, 4B and 6, primary sections 406, 408 are assembled to include the desired number of turns and layers and then each half of those sections are fit together. Such fitting may be a snap or compression fit as described above. The same may be done for the secondary section 410. A lower spacer 414 (as either a single or multi-section element) is placed into the lower half 402*b*. The lower spacer 414 may be sized and arranged to mate with the outer core arms 480/482 so that it cannot rotate and such that it forms an offset from the lower half 402*b* into which a casing (any of casings 602, 604, 606) may be placed. In this example, the primary section 408 is then inserted such that it surrounds the inner arm 484 and seats into the lower spacer 414. Lower inner spacer 418 is then inserted followed by secondary section 410. Then, in an opposite orientation, the upper inner spacer 416 is placed on top of the secondary section 410 and then the primary section 406 is placed in the upper inner spacer 416. Upper spacer 412 is placed on top of primary section 406 and then the upper half 402 is inserted through the inner void of the primary section 406 and the secondary section 410 to form a completed transformer. With additional reference to FIG. 5, in the above example, the inner void 572 is sized such that is it larger than the outer size of the inner arm 484 of the core 402. As shown, the inner void 572 is circular and has radius r3 where r1>r2>r3. Below, how each section is formed will be described.

Figure 7:
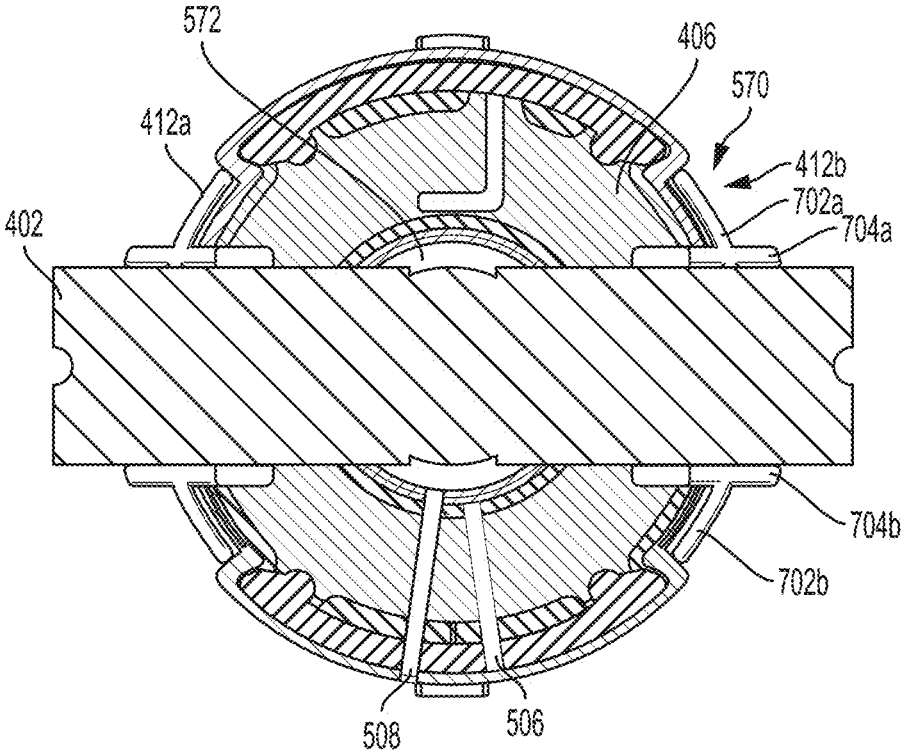
FIG. 7 shows a top view of the transformer shown in FIG. 4A.

FIG. 7 is a top view of a transformer 400 showing how a spacer (in this case, upper spacer 412, mates with a transformer section (section 406) and the core 402. Spacer 412*b* will be described but it shall be understood that these teachings can be applied to any spacer. The spacer 412*b* includes outward extending arms 702*a*, 702*b* that are sized and configured to substantially fill the notch 570. The spacer 412*b* also includes core spacing arms that set on either side of the core 402 and cause a separation between the core and the transformer section.

Figure 8:
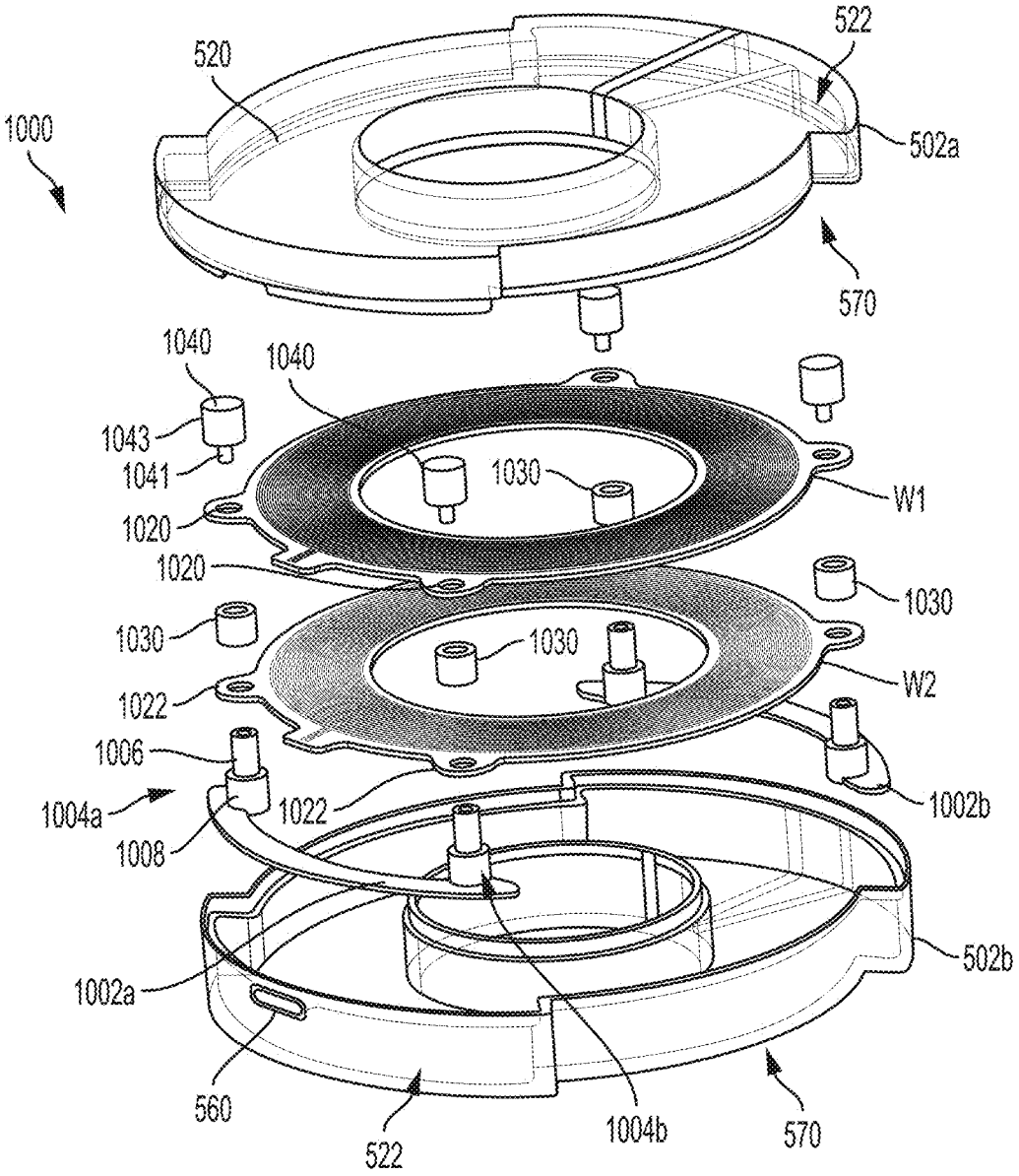
FIG. 8 shows an exploded view of a winding assembly according to one embodiment.

FIG. 8 shows an exploded view of a shielded winding portion 1000 of a transformer. The portion includes a casing 502 (with upper and lower portions 502*a*, 502*b*). This casing 502 can be formed as described above.

The casing 502 illustrated surrounds two windings W1 and W2. Of course, more windings could be provided based on the teachings herein. The other elements in FIG. 8 are used to align the windings in the casing and to each other. Windings W1 and W2 can be either primary or secondary windings and both are formed on a printed circuit board. Herein below, reference to W1 or W2 also includes reference to the circuit board on which windings are printed. As illustrated, both windings W1 and W2 include board alignment elements 1020 and 1022.

The casing 502 includes turn entrance 560. The turn entrance could be in either upper or lower portion 502*a*, 502*b*.

The casing 500 includes an inner portion 520 and one or more tabs 522 that extend outwardly from the inner portion 520 the tabs arranged to form a notch 570 between them. The sizing of the tabs 520 and notch 570 may be as described above in one embodiment but that is not required as the teachings related to FIG. 8 may be applied to different transformer orientations than those described above.

A lower winding spacer 1002 (shown as two separate pieces 1002*a*/1002*b*) are disposed in tabs 520. The lower winding spacers 1002*a*/1002*b* include one or more stepped mounting member 1004*a*/1004*b*. Each stepped mounting member 1004 includes a first mounting member portion 1008 and a second mounting member portion 1006. The second mounting member portion 1006 has a smaller outer perimeter than and extends from the first mounting member portion 1008.

The second mounting member 1006 portion is sized and arranged such that it can extend through one of the first board alignment elements (e.g., elements 1022 of W2) and the printed circuit board labelled as W2 is supported by the first mounting member portion.

The assembly also includes hollow spacers 1030 disposed on a top of W2 that surround the second mounting member portion 1006 when assembled. W1 sets on top of the spacers 1030 and the spacers 1030 separate W1 from W2. Spacing screws 1040 pass through W1 and include a screw portion 1041. The screw portion has as smaller diameter than a body 1043 of the spacer. In one embodiment, the screw portion 1043 is sized to fit inside and mate with the second mounting member portion 1006 after through alignment elements 1020, spacers 1030 and alignment element 1022. The body 1043 also serves as spacer between W1 and upper portion 502*a*.

In this manner, the two windings W1 and W2 are held fixed relative to one another and from the casing. Further, assembly may be simple and not require precise alignments to be made by the assembler as the lower winding spacer 1002 define the relative spacing of the windings in the casing 502 and, in combination with spacers 1030 and spacing screws, the spacing of the windings relative to the casing.

During an actual assembly, lower winding spacers 1002*a*/1002*b* are disposed in the lower casing portion 502*b*. W2 is set on top of the lower winding spacers 1002 such that the second mounting member portions 1006 passes through alignment elements 1022 and W2 rests on first mounting member portions 1008.

Hollow spacers 1030 are then disposed on a top of W2 such they surround the second mounting member portion 1006. W1 is then set on top of the spacers 1030 and spacing screws 1040 are inserts such that the screw portion 1041 thereof mates with the second mounting member portion 1006. The upper casing portion 502*a* is then snapped into the lower casing portion 502*b* to for a completed winding protion that can be used in any embodiments disclosed herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts and equivalents of all means or step plus function elements in the claims below are intended to include any structure, material or act for performing the function in combination with other claimed elements as claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While embodiments have been described, it will be understood that those skilled in the art, both now and in the future, may make various improvements and enhancements which fall within the scope of the claims which follow. These claims should be construed to maintain the proper protection for the invention first described.

What is claimed is:

1. A transformer comprising:

a core having a central arm and first and second outer arms on opposite sides of the of the central arm;

first and second primary windings surrounding the central arm;

a secondary winding surrounding the central arm;

a primary winding casing completely surrounding the first and secondary primary windings, the primary winding casing including a primary conductive shield layer disposed on an inside of the primary winding casing that reduces electromagnetic interference;

a secondary winding casing completely surrounding the secondary winding, the secondary winding casing including a secondary conductive shield layer disposed on an inside of the second winding casing that reduces electromagnetic interference;

at least two spacers including a first spacer and a second spacer wherein:

the first spacer is configured and arranged to space the primary winding casing away from a bottom of the core and the outer arms; and the second spacer is located between the primary winding casing and the secondary winding casing is configured and arranged to space the secondary winding casing away from the primary winding casing and the outer arms.

2. The transformer of claim 1, further comprising:

an additional primary winding surrounding the central arm; and an additional primary winding casing surrounding the additional primary winding;

wherein the additional primary winding is disposed on a first side of the secondary winding casing and the first and second primary windings are disposed on a second side of the secondary winding casing opposite the first side.

3. The transformer of claim 2, wherein the at least two spacers includes a third spacer and a fourth spacer, wherein the third spacer is disposed between the secondary winding casing and the additional primary winding casing; and wherein the fourth spacer is configured and arranged to space the additional primary winding casing away from a top of the core and the outer arms.

4. The transformer of claim 2, wherein the primary winding casing, the secondary winding casing and the additional primary winding casing each include a turn entrance thorough which a connector may pass.

5. The transformer of claim 4, wherein the turn entrance of the primary and additional primary winding casings are on a first side of the transformer and the turn entrance of the secondary winding casing is on a second side of the transformer opposite the first side.

6. The transformer of claim 1, wherein the primary and secondary windings are formed on a printed circuit board.

7. The transformer of claim 1, wherein the primary and secondary casings include portions formed of a plastic material.

8. The transformer of claim 7, wherein the primary and secondary casings include an electromagnetic interference reducing coating on outer portions thereof.

9. A method of forming a transformer, the method comprising:

providing a bottom portion of a core having a central arm and first and second outer arms on opposite sides of the of the central arm;

forming first and second primary windings;

forming a second winding;

disposing the first and second primary windings in a first winding casing including a first winding casing conductive shield layer disposed on an inside of the first winding casing that reduces electromagnetic interference, wherein the first winding casing completely surrounds the first and second primary windings;

disposing the second winding in a second winding casing including a second winding casing conductive shield layer disposed on an inside of the second winding casing that reduces electromagnetic interference, wherein the second winding casing completely surrounds the second winding;

placing a first spacer on the bottom portion of the core;

disposing the first winding casing on the first spacer;

placing a second spacer on top of the first winding casing; and disposing the second winding casing on the second spacer.

10. The method of claim 9, further comprising:

forming a third winding;

disposing the third winding in a third winding casing;

placing a third spacer on the second winding casing;

disposing the third winding casing on the second spacer.

11. The method of claim 10, further comprising:

placing a fourth spacer on the third winding casing; and disposing a top portion of the core on top of the bottom half.

12. The method claim 10, wherein the third winding is a primary winding and the second winding is secondary winding.

13. The method of claim 10, wherein the first winding casing, the second winding casing and the third winding casing each include a turn entrance thorough which a connector may pass.

14. The method of claim 13, wherein the turn entrance of the third winding cases are on a first side of the transformer and the turn entrance of the second casing is on a second side of the transformer opposite the first side.

15. The method of claim 9, wherein the first and second primary windings and the second winding are formed on a printed circuit board.

16. The method of claim 9, wherein the first and second winding casings are formed of a plastic material.

17. The method of claim 9, wherein the first and second casings include an electromagnetic interference reducing coating on outer portions thereof.

* * * * *